US008474613B2

(12) United States Patent
Murdoch et al.

(10) Patent No.: US 8,474,613 B2
(45) Date of Patent: Jul. 2, 2013

(54) CARRIER FOR PHOTOGRAPHIC EQUIPMENT SUCH AS CAMERAS AND LENSES

(75) Inventors: Douglas Harland Murdoch, Santa Rosa, CA (US); Michael Sturm, Redding, CA (US)

(73) Assignee: Think Tank Photo, Inc., Santa Rosa, CA (US)

( * ) Notice: Subject to any disclaimer, the term of this patent is extended or adjusted under 35 U.S.C. 154(b) by 109 days.

(21) Appl. No.: 12/529,141

(22) PCT Filed: Feb. 27, 2008

(86) PCT No.: PCT/US2008/055194

§ 371 (c)(1), (2), (4) Date: Aug. 28, 2009

(87) PCT Pub. No.: WO2008/106559

PCT Pub. Date: Sep. 4, 2008

(65) Prior Publication Data

US 2010/0065453 A1 Mar. 18, 2010

Related U.S. Application Data

(60) Provisional application No. 60/904,603, filed on Mar. 1, 2007.

(51) Int. Cl.
*B65D 85/38* (2006.01)

(52) U.S. Cl.
USPC ..... 206/316.2; 224/240; 224/675; 224/908

(58) Field of Classification Search
USPC ..... 206/316.1, 316.2, 316.3, 484, 484.2; 150/154; 190/103–105; 229/101; 224/272, 224/583, 904, 908, 909, 930; 383/2
See application file for complete search history.

(56) References Cited

U.S. PATENT DOCUMENTS

| | | | | |
|---|---|---|---|---|
| 2,691,401 | A * | 10/1954 | Kontoff et al. | 206/316.1 |
| 2,729,257 | A * | 1/1956 | Kepper | 383/2 |
| 3,813,017 | A * | 5/1974 | Pimsleur | 206/316.2 |
| 4,361,215 | A * | 11/1982 | Sawai | 190/18 A |
| 4,739,880 | A * | 4/1988 | Sawyer et al. | 206/223 |
| 4,923,060 | A * | 5/1990 | Breslau | 206/316.2 |
| 5,267,679 | A * | 12/1993 | Kamaya et al. | 206/316.2 |
| 5,324,115 | A * | 6/1994 | Weinreb | 383/2 |
| 2002/0088059 | A1 * | 7/2002 | Reeves | 383/4 |
| 2005/0286807 | A1 * | 12/2005 | Matheus et al. | 383/2 |
| 2006/0151560 | A1 * | 7/2006 | Chen | 190/103 |

* cited by examiner

*Primary Examiner* — Luan K Bui
(74) *Attorney, Agent, or Firm* — R. Dabney Eastham

(57) ABSTRACT

A carrier has a variable-length compartment for receiving a device of variable length, such as a lens with a hood that may be alternated between a reversed and an extended or operative position. The carrier has an expansion gusset region that allows expansion of the carrier along one dimension when the device is elongated, whereby the carrier is able to securely accommodate the elongated device within the compartment, and contraction of the carrier when the device is less elongated.

12 Claims, 18 Drawing Sheets

CARRIER FOR PHOTOGRAPHIC EQUIPMENT SUCH AS CAMERAS AND LENSES

CROSS-REFERENCE TO RELATED APPLICATIONS

This application claims the benefit of U.S. provisional patent application Ser. No. 60/904,603, filed on Mar. 1, 2007 for a "Carrier for Photographic Equipment such as Cameras and Lenses," by Douglas Harland Murdoch and Michael Sturm, and assigned to Think Tank Photo, Inc. The disclosure of U.S. provisional patent application Ser. No. 60/904,603 is incorporated herein by reference to the extent permitted by law.

STATEMENT REGARDING FEDERALLY SPONSORED RESEARCH OR DEVELOPMENT

Not applicable.

FIELD OF THE DISCLOSURE

The field of this disclosure is that of article carriers supported by an animate bearer, such as a human being.

BACKGROUND

Human beings have long carried articles by attaching them to belts worn around the waist or hips or to harnesses or slings supported at least in part by the shoulders. Such articles have included canteens, weapons, food, and the like. Carriers such as bags or pouches for receiving and supporting the articles may be supported by the belt, harness or sling.

Photographers often carry their photographic gear in carriers such as pouches or bags that are supported by a belt, harness or sling. Such photographic gear may include lenses and camera bodies with lenses attached.

The lenses that may be attached to a single lens reflex or medium format camera body are usually cylindrically shaped objects of varying lengths. Telephoto lenses and other lenses with a long focal length are typically longer along the major axis of the generally cylindrical lens than are shorter focal length lenses.

Carriers for lenses and for cameras with lenses attached preferably should have compartments shaped to receive these devices in order to securely contain them without excess movement of the lenses and the cameras with lenses inside the compartment.

Photographers frequently attach lens hoods to their lenses when taking pictures, in order to shield the lens from a source of bright light such as the sun. This will result in pictures that are not distorted or washed out by the bright light. The lens hood is attached to the front of the lens and projects from the lens in order to shelter the light-gathering element of the lens from the bright light. The lens hood may be removed from the lens, usually by rotating it so that it disengages from a ridge or other locking element on the front of the lens.

The lens hood adds to the length of the lens when it is attached to the lens in an operative position. Being longer, the lens and hood (or camera with lens having hood attached) will not be accommodated in a carrier shaped to fit the lens (or camera with lens) without the hood attached in the operative position, unless the compartment is oversized to begin with or the lens or camera with lens projects out of the compartment. Having an oversized compartment means that the carrier is oversized. This is usually not desirable in order to avoid excess movement and especially in carriers that are meant to be carried on the photographer's body by a belt, harness, sling or the like. On the other hand, allowing the lens or camera with lens to project out of the compartment exposes it to hazards such as rain and other moisture, dust, theft, and the chance of simply falling out of the compartment.

Usually the lens hood can be reversed on the lens so that it does not project beyond the light-gathering element of the lens. The lens will be wider where the hood surrounds it. A carrier with a compartment shaped to fairly closely fit the lens (or camera with lens) can usually accommodate the lens (or camera with lens) with a reversed hood.

Photographers such as sports and combat photojournalists must be ready to take pictures of short-lived and unpredictable events. They will prefer to keep their equipment as ready for use as possible. This may require leaving the lens hood in a deployed or operative position on the lens so that the photographer does not have to take the time to attach a lens hood to the lens or, if one is attached to the lens in a reversed position, to remove the reversed lens from the lens, turn it around, and reattach it.

A need exists, therefore, for a carrier for a lens or a camera with a lens that can accommodate the lens or the camera with a lens wherein the lens has no hood attached, has a hood is in a deployed position or has a hood reversed on the lens. The carrier should be able to accommodate the lens or a camera with lens in a fully enclosed or secure way in all of these conditions and it should do so without being permanently oversized.

SUMMARY OF THE DISCLOSURE

The present disclosure provides, in one aspect, a carrier for carrying photographic gear, such as a lens or a camera with a lens, the carrier comprising a wall and a bottom joined by an expanding gusset region to define a variable-length compartment. The expanding gusset region may comprise a gusset and a device at least partially secured to or adjacent to each of the wall and the bottom for reversibly engaging the bottom adjacent the wall. The gusset may have a contracted configuration in which the wall is adjacent the bottom and an expanded configuration in which the wall is spaced from the bottom. The device may be a zipper. The wall may define an opening for access to the variable length compartment. The opening may be secured by a flap or a top.

Without limitation, it is an object and advantage of the present invention to provide a carrier for a lens or a camera having a lens that can securely accommodate the lens or the camera having a lens wherein a lens hood is in a deployed position, is reversed on the lens or no lens hood is on the lens at all.

Another object and advantage is to provide a carrier for a lens or a camera having a lens that can securely accommodate the lens or the camera having a lens wherein the lens is of different lengths.

DESCRIPTION OF THE DRAWINGS

The present invention will be understood and appreciated more fully from the following detailed description taken in conjunction with the drawings. The accompanying drawings, which constitute part of this specification, help to illustrate embodiments of the disclosure. In the drawings, like numerals are used to indicate like elements throughout. The drawings are described below.

REFERENCE NUMERALS IN THE DRAWINGS

Figure 1:
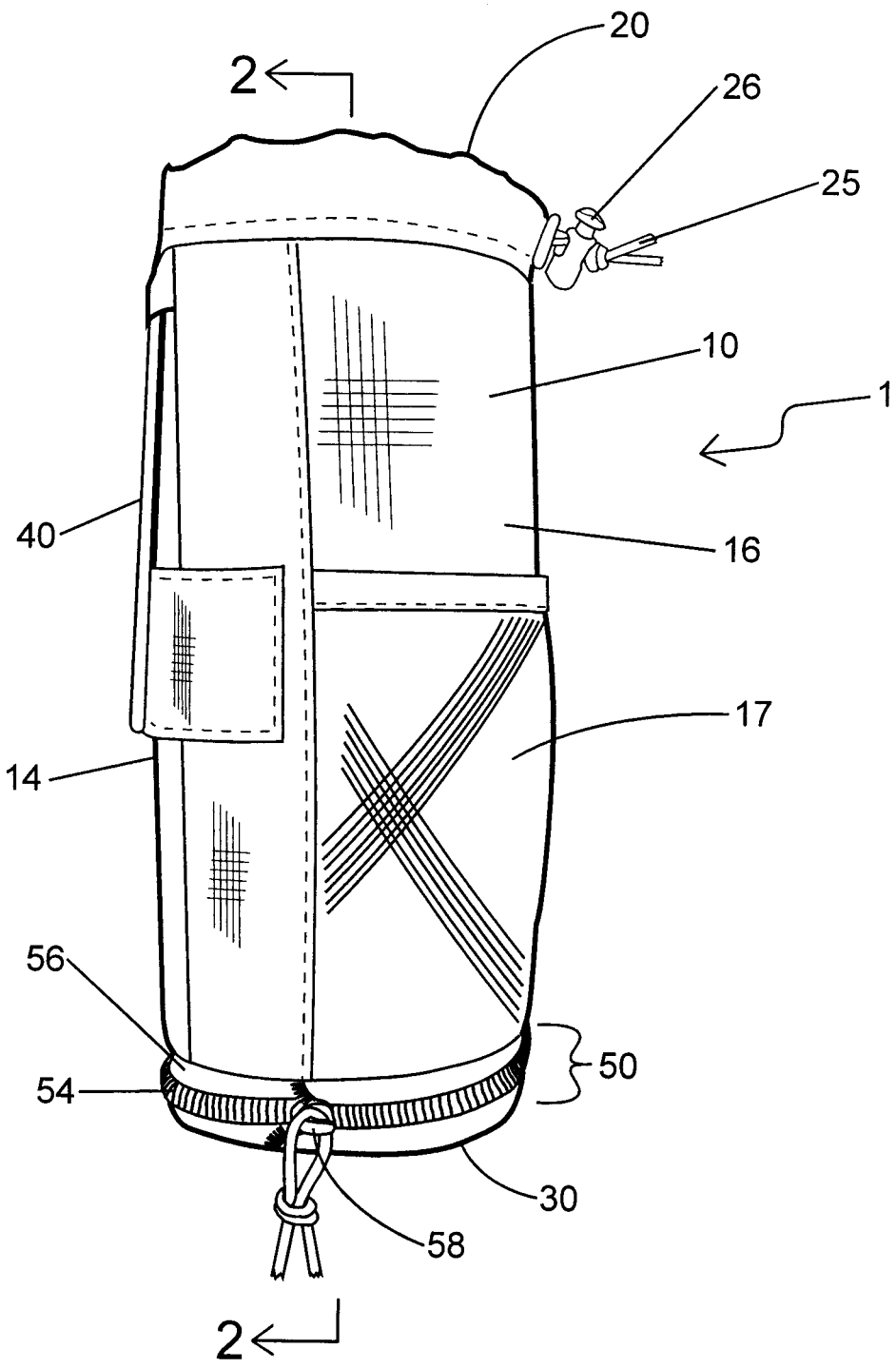
FIG. 1 is a left side perspective view of a first preferred embodiment of a carrier according to the disclosure, in the first or non-extended configuration.

1 carrier, first embodiment
2 lens, shown in phantom
2A lens hood, shown in phantom
10 wall
12 foam padding
14 body contacting portion of wall
15 compartment
16 non-body contacting portion of wall
17 mesh
20 top
22 opening in top
25 cord
26 toggle lock
30 bottom
32 foam padding
40 belt connection sleeve
50 expansion gusset region
52 gusset
54 zipper
54A upper half of zipper
54B lower half of zipper
56 zipper tape
56A upper zipper tape
56B lower zipper tape
58 zipper slider
100 carrier, second embodiment
105 camera body
107 lens
107A lens hood
110 wall
111 foam padding
112 front wall
115 compartment
114 back wall
116 left wall
117 zippered left side compartment
118 right wall
120 top
121 foam padding
122 handle
123 hinge
124 top opening
126 top opening zipper
128 top opening zipper slider
130 bottom
131 foam padding
140 belt connection sleeve
150 expansion gusset region
152 gusset
154 zipper
154A upper half of zipper
154B lower half of zipper
156 zipper tape
156A upper zipper tape
156B lower zipper tape
158 zipper pull

DETAILED DESCRIPTION OF THE PREFERRED EMBODIMENTS

For the purposes of this specification, unless otherwise indicated, all numbers expressing quantities of ingredients and so forth used in the specification are to be understood as being modified in all instances by the term "about." Accordingly, unless indicated to the contrary, the numerical parameters set forth in the following specification are approximations that can vary depending upon the desired properties sought to be obtained by the present disclosure.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub ranges subsumed therein, and every number between the end points. Additionally, any reference referred to as being "incorporated herein" is to be understood as being incorporated in its entirety.

It is further noted that, as used in this specification, the singular forms "a," "an," and "the" include plural referents unless expressly and unequivocally limited to one referent.

Referring now to the drawings, FIGS. 1-5 depict a first preferred embodiment of a carrier 1 according to the disclosure. The carrier 1 is essentially a pouch designed to carry an essentially cylindrical elongated object with a varying length, in this case a telephoto lens that may have its lens hood either reversed (see FIG. 2) or extended (see FIG. 4).

The carrier 1 has a wall 10 attached by an expansion gusset region 50 to a bottom 20. The wall 10 and the bottom 20 together define a compartment 15 that has an opening 22 at the top 20.

The wall 10 and the bottom 30, as shown in the drawings, are each formed of two pieces of fabric that sandwich a foam sheet 12 and 32, respectively. The wall 10 and the bottom 30 are each sewn to the expansion gusset region 50 (described below). It will be understood by those of skill in the art how to make and join the wall 10 and the bottom 30 to the expansion gusset region, as well as the variations in the materials and manner of construction that may be employed.

The wall 10 in the embodiment shown in the drawings has two portions: a body contacting wall 14 and a non-body contacting wall 16 joined to each other. The body contacting wall 14 has attached to it a belt connection sleeve 40 that permits the user to connect the carrier 1 to a belt (not shown). A preferred form of a belt connection sleeve is shown in the co-pending PCT application no. PCT/US2005/034036 of one of the current inventors, Douglas H. Murdoch, for a "Carrier System," published as WO/2006/034421, the disclosure of which is incorporated by reference as if fully set forth herein, to the extent permitted by law. A preferred form of a belt is shown in the co-pending PCT application no. PCT/US2006/061357 of the current inventors, Douglas H. Murdoch and Michael Sturm, for a "Carrier System," the disclosure of which is incorporated by reference as if fully set forth herein, to the extent permitted by law.

The non-body contacting wall 16 is shown with an elastic mesh panel 17 sewn thereon that forms a pocket for small articles such as lens caps, food bars, sun lotion containers, and the like.

The top 20 of the wall 10 is equipped with a cord 25 in a tunnel at the top 20. The cord 25 may be drawn tight and cinched in place by the toggle lock 26. Those of skill in the art will understand that other means of closing the opening 22 to secure the contents of the compartment 15 may be employed, such as a zippered lid and the like.

The construction of the carrier 1, as described to this point and excluding the expansion gusset region 50, is known. For example, Think Tank Photo offers a soft-sided lens carrier of the general construction described thus far (but excluding the expansion gusset region 50) under the name "Lens Changer [size number]." See, for example http://www.thinktankphoto.com/ttp_product_LnsChngr80.php (accessed Feb. 7, 2007).

Although a "soft" construction of the carrier 1 is described in this specification, it could have a "hard" construction, which means that the wall and bottom would be made of materials harder or more rigid than fabric and foam sheets sewn together. For example, the wall and bottom could be made of a thermoplastic material such as the hard-sided cases sold by Pelican products, Inc. and the like. A hard-sided carrier preferably may have a different closure than a cord and toggle lock closure, which is easier to accomplish with a soft-sided carrier 1.

Figure 2:
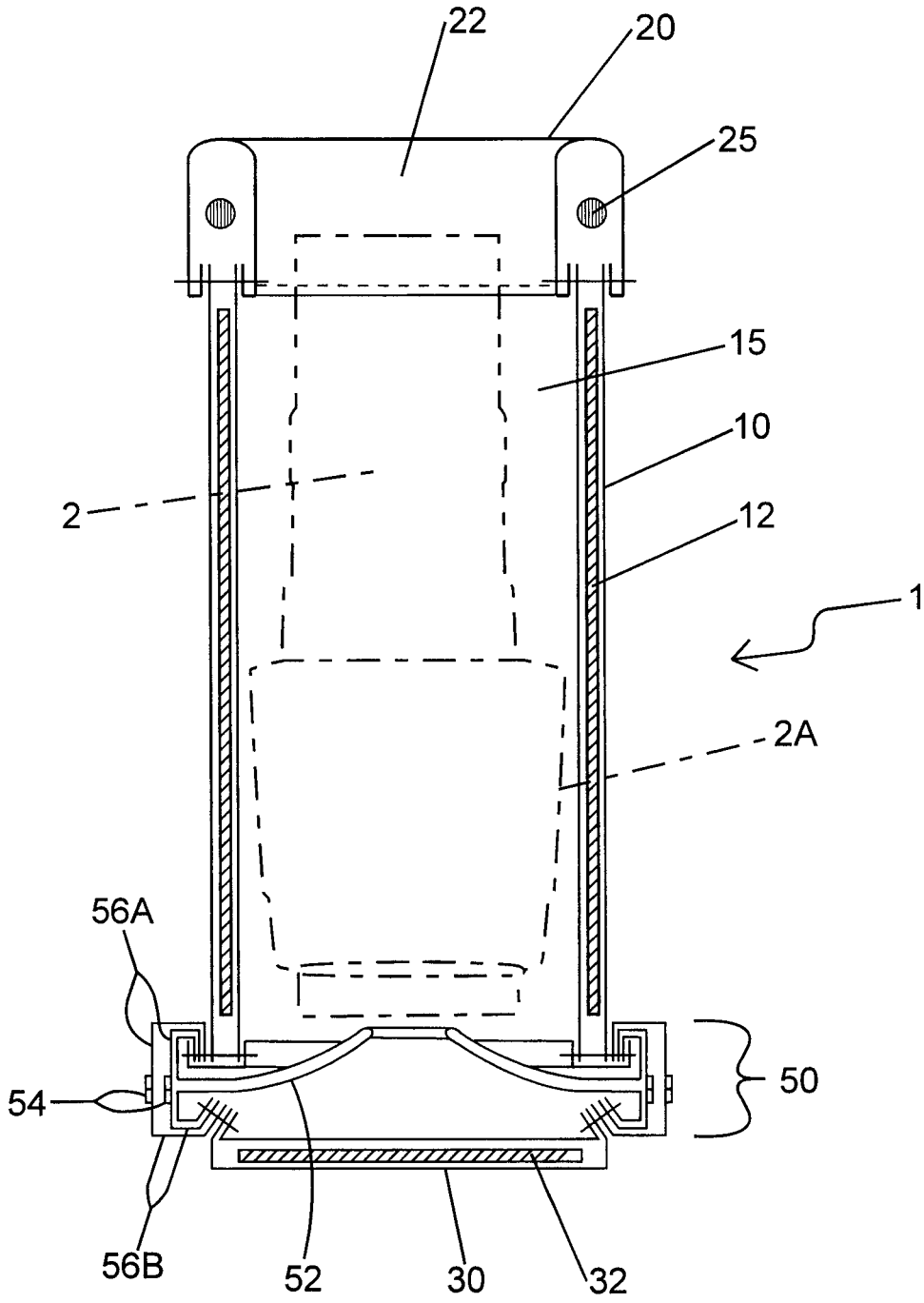
FIG. 2 is a schematic of a sectional view of the carrier shown in FIG. 1, taken along the line 2-2, with a lens indicated in phantom.

FIGS. 1 and 2 show the carrier 1 in the unextended configuration. As shown in the schematic cross-section of FIG. 2, this would be appropriate for carrying a lens 2 with the hood 2A reversed on the lens. In this configuration the expansion gusset region 50 is not extended. Instead, it is in its contracted form.

Figure 3:
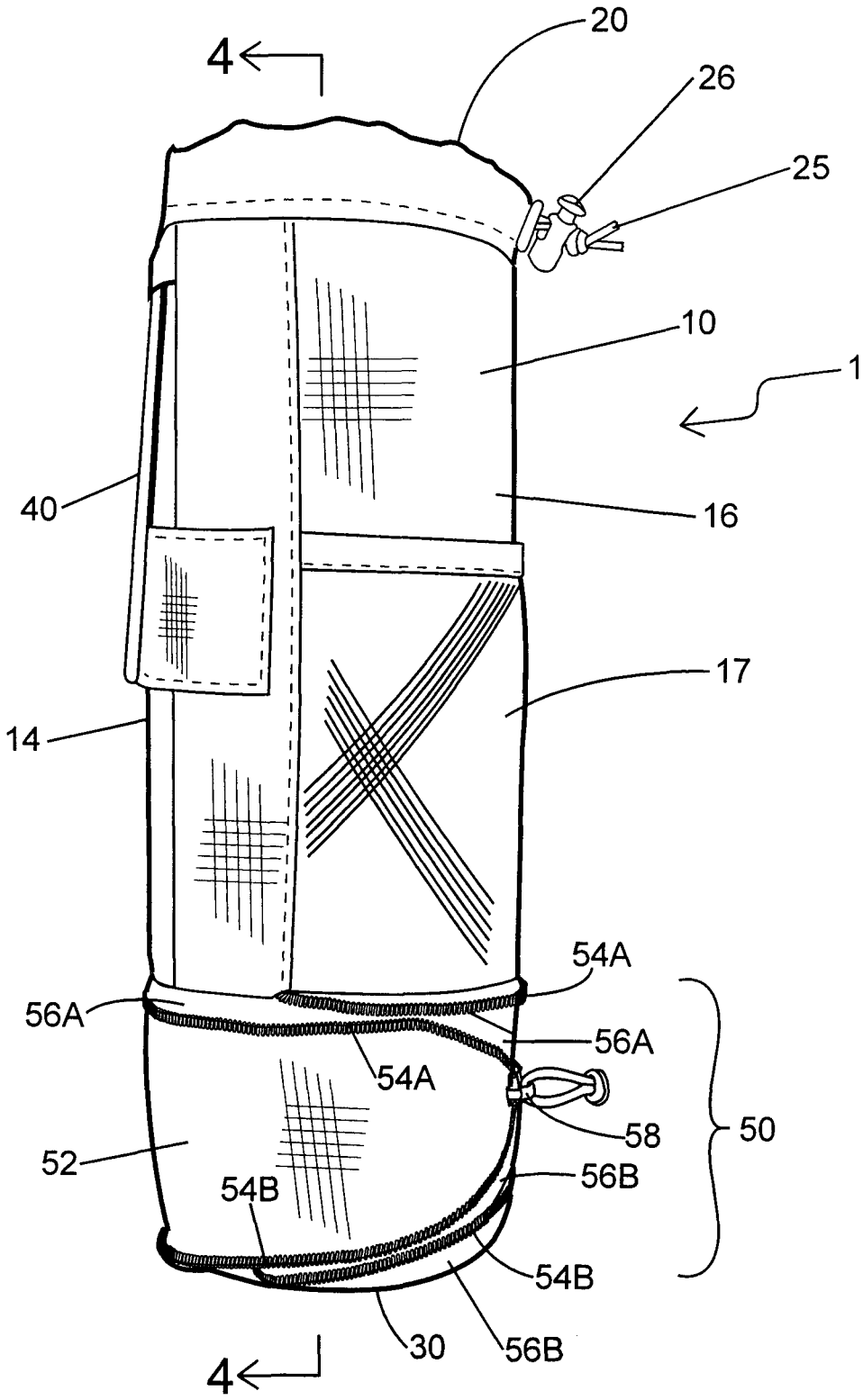
FIG. 3 is a left side perspective view of the carrier shown in FIG. 1, but in the second or extended configuration.
Figure 4:
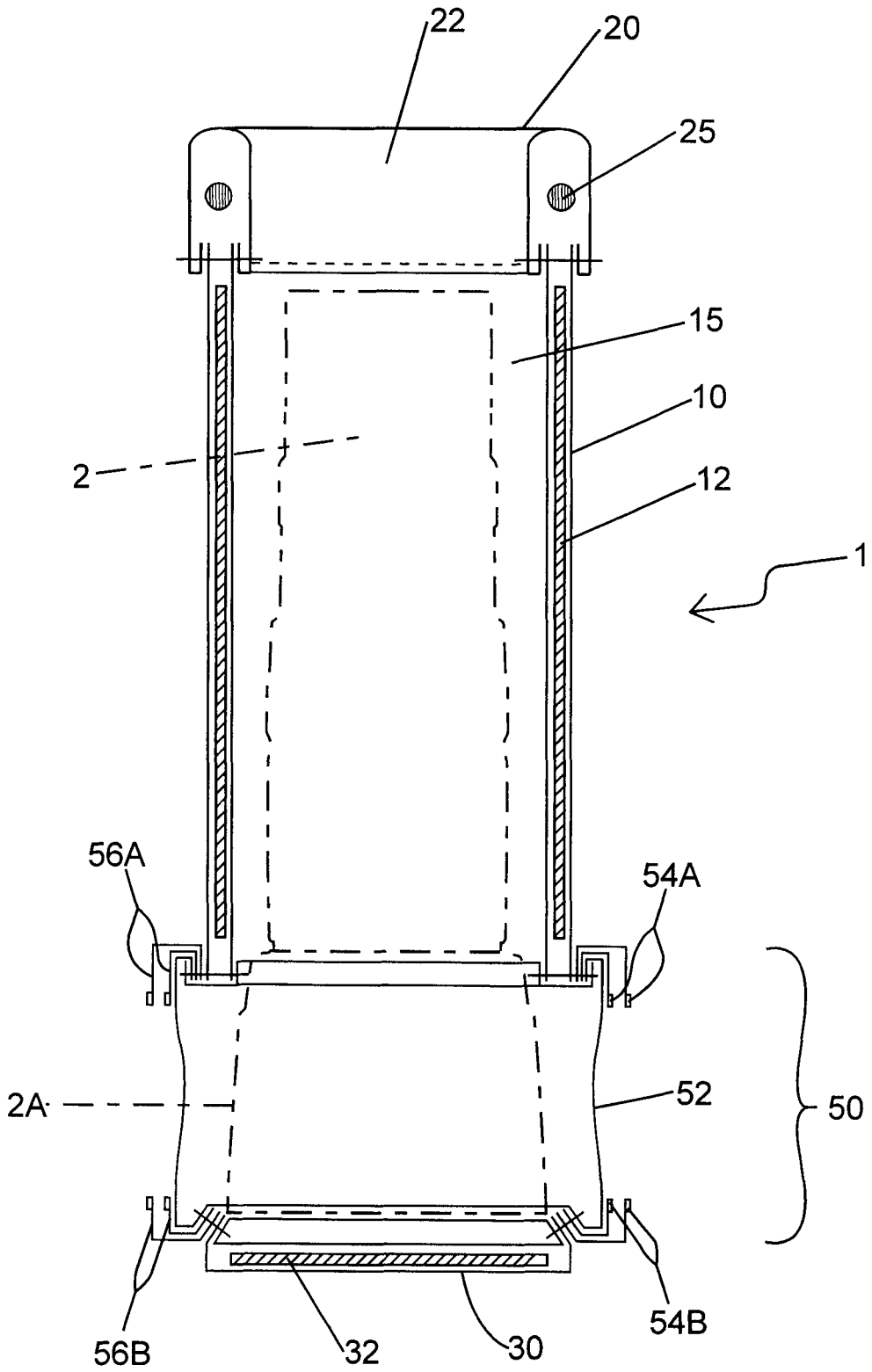
FIG. 4 is a schematic of a sectional view of the carrier shown in FIG. 3, taken along the line 4-4, with a lens indicated in phantom.
Figure 5:
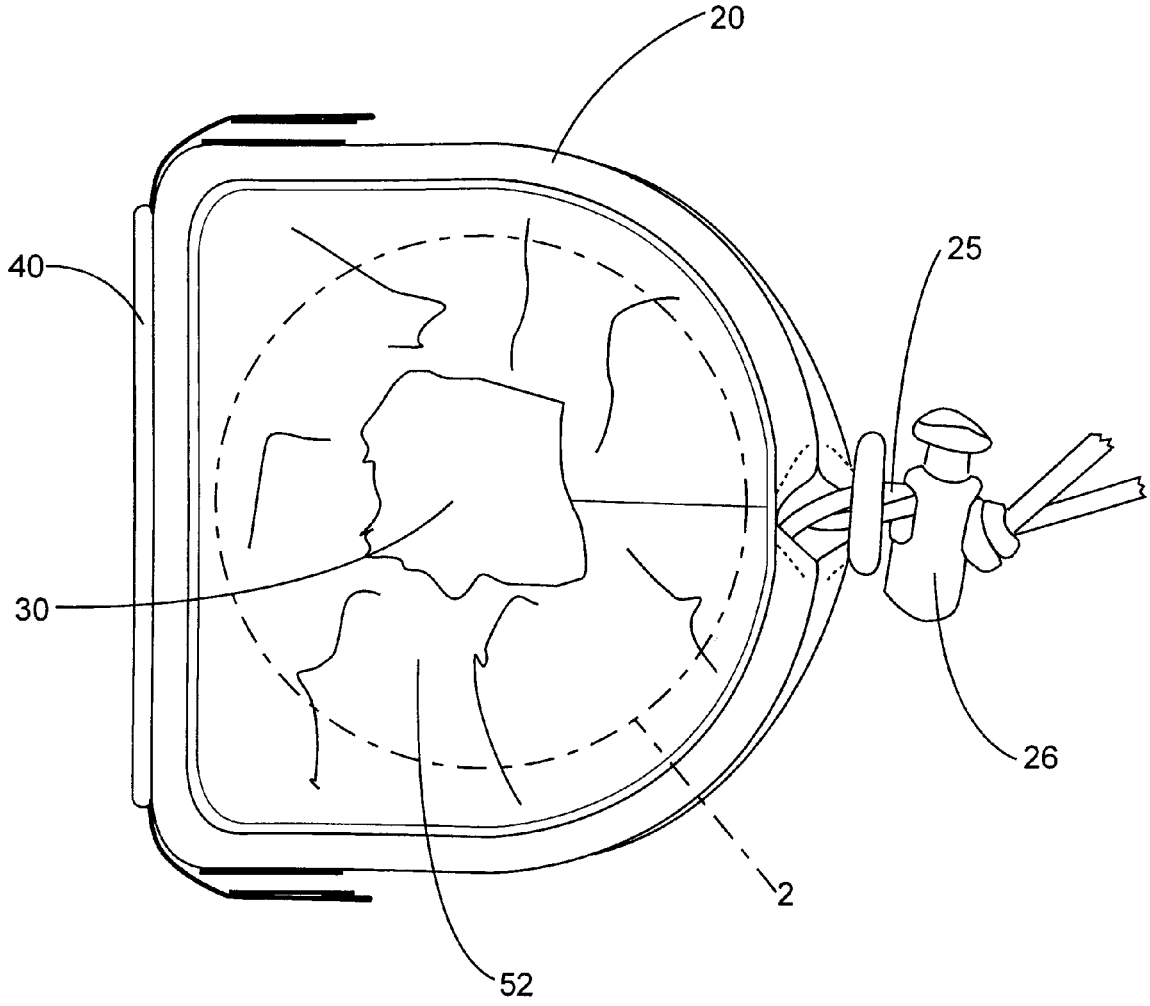
FIG. 5 is a top side perspective view of the carrier shown in FIG. 1, in the first configuration.
Figure 6:
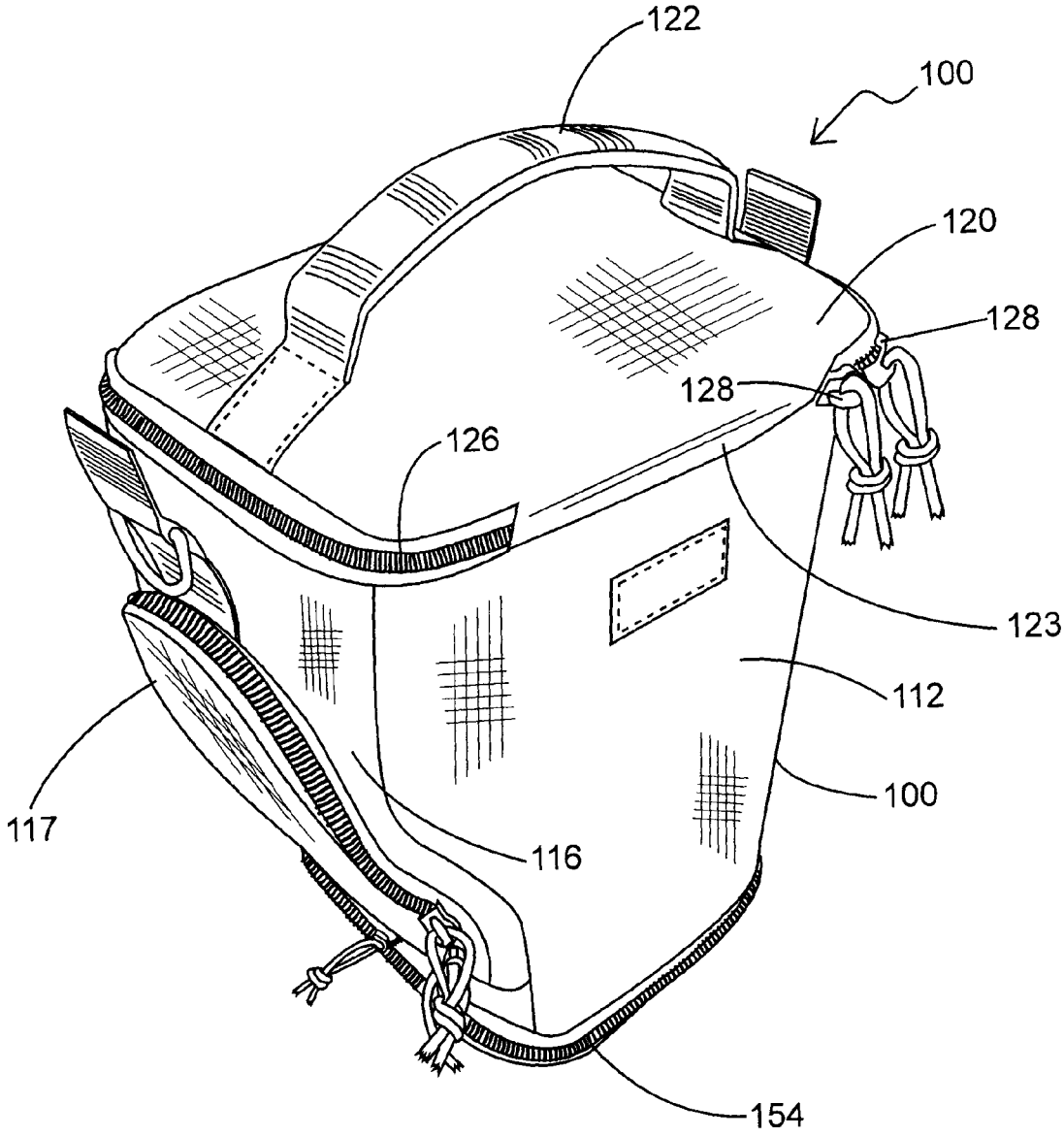
FIG. 6 is a elevated perspective view of a second preferred embodiment of a carrier according to the disclosure, in the first or non-extended configuration.
Figure 7:
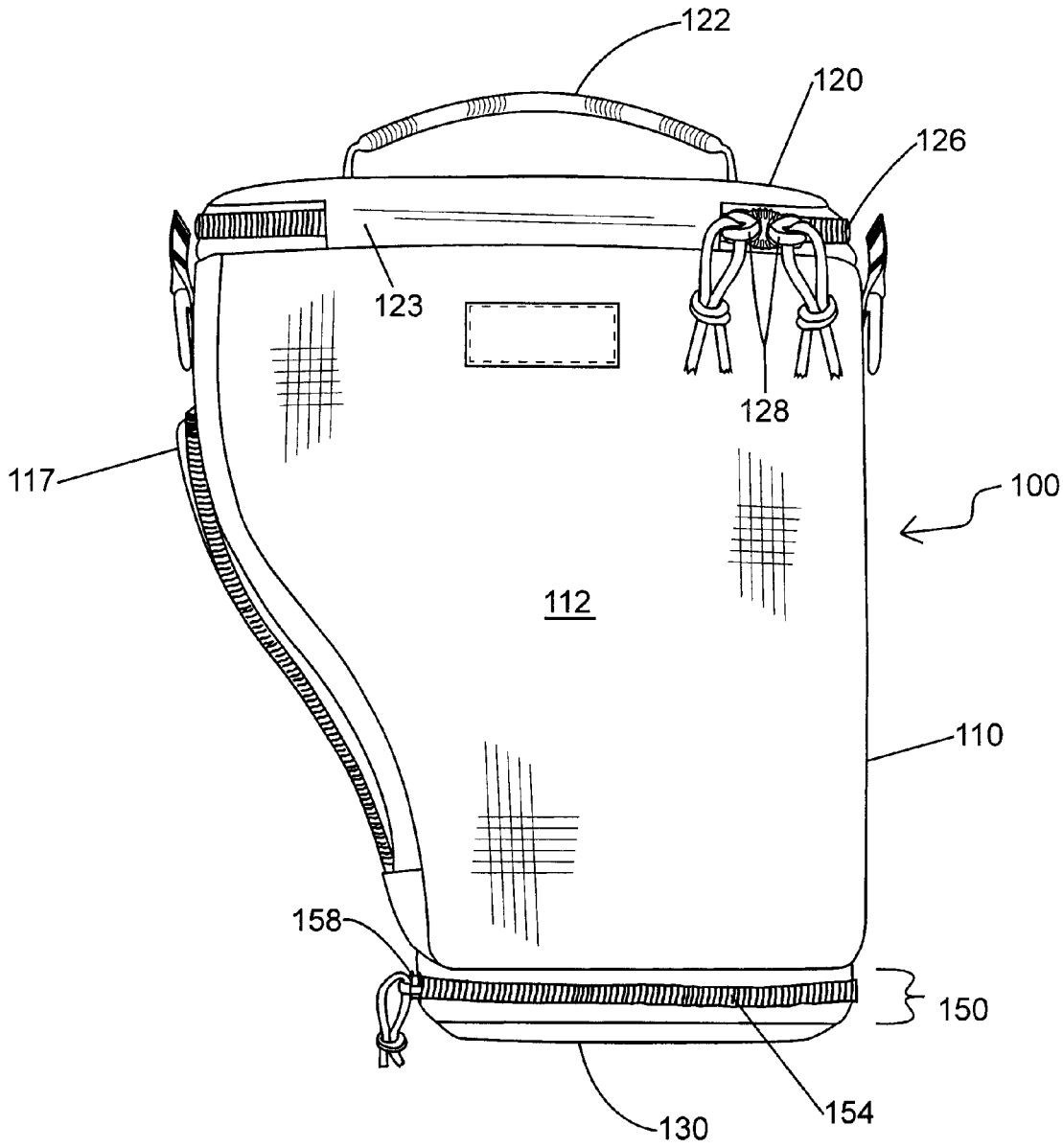
FIG. 7 is a front side perspective view of the carrier shown in FIG. 6.
Figure 8:
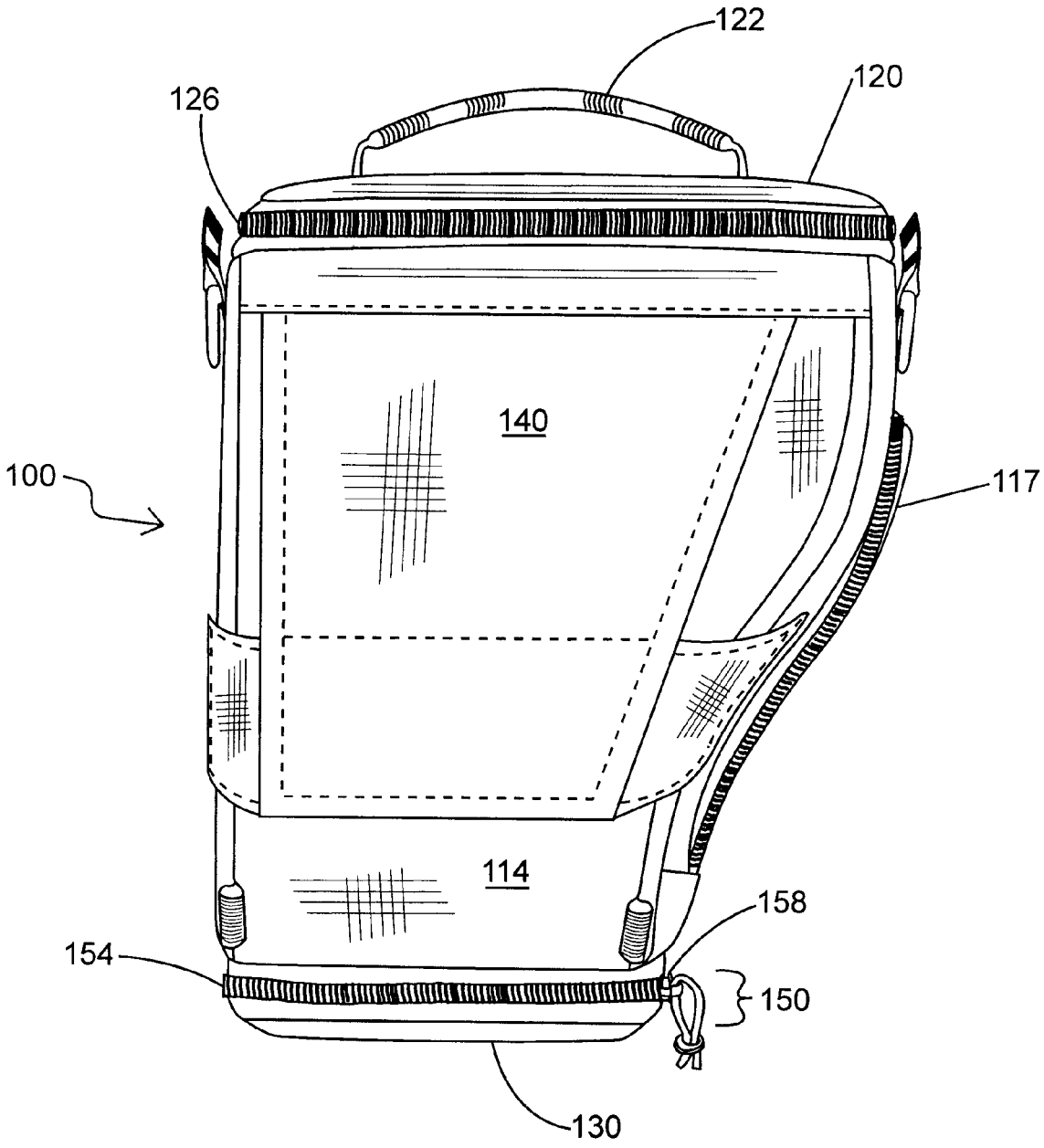
FIG. 8 is a back side perspective view of the carrier shown in FIG. 6.
Figure 9:
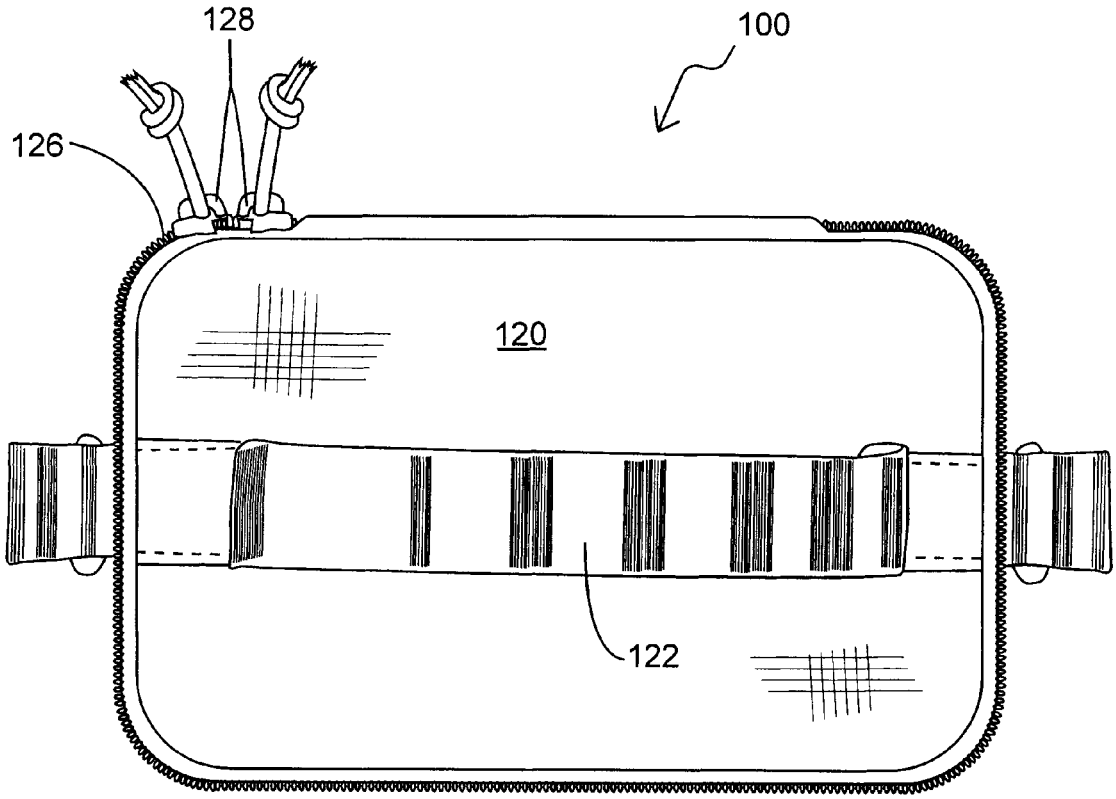
FIG. 9 is a top perspective view of the carrier shown in FIG. 6.
Figure 10:
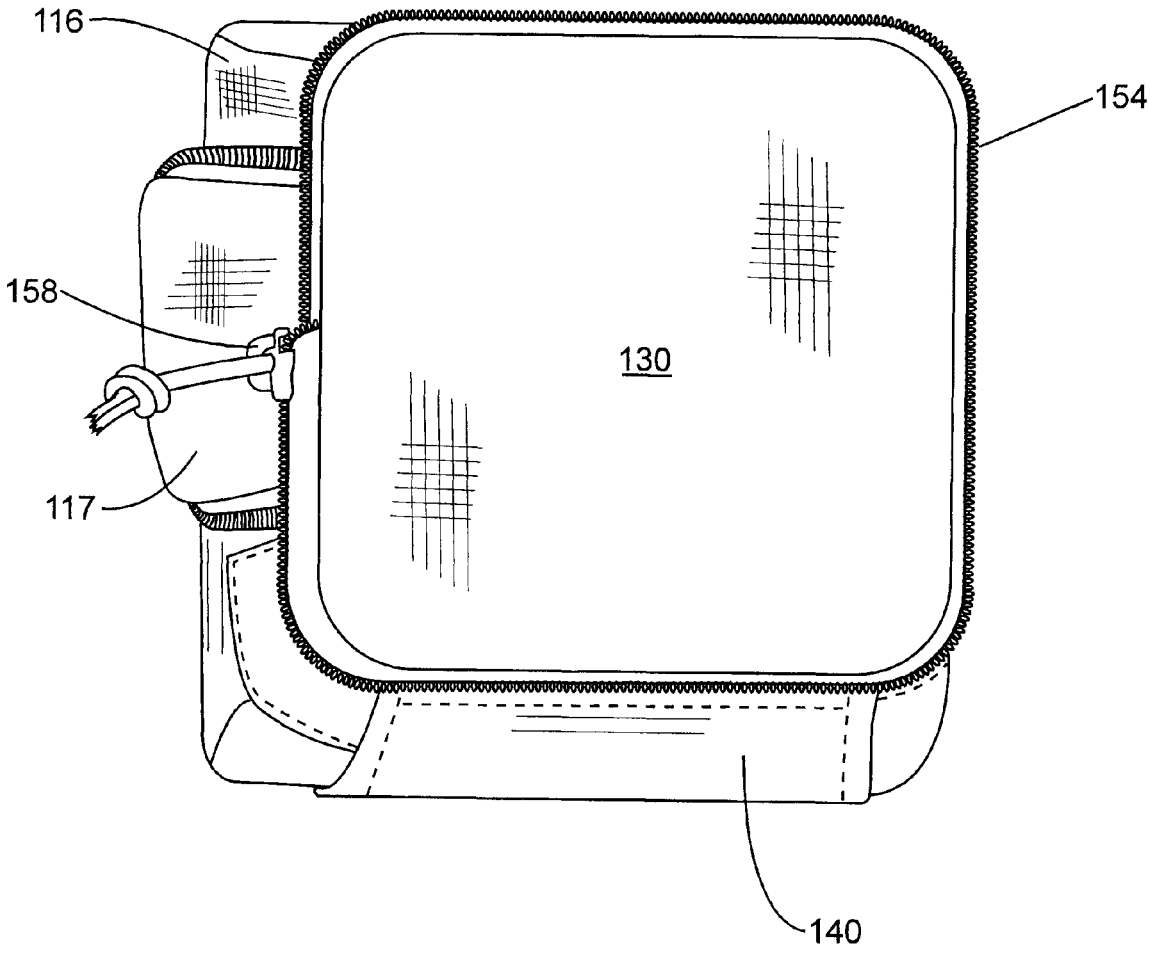
FIG. 10 is a bottom perspective view of the carrier shown in FIG. 6.
Figure 11:
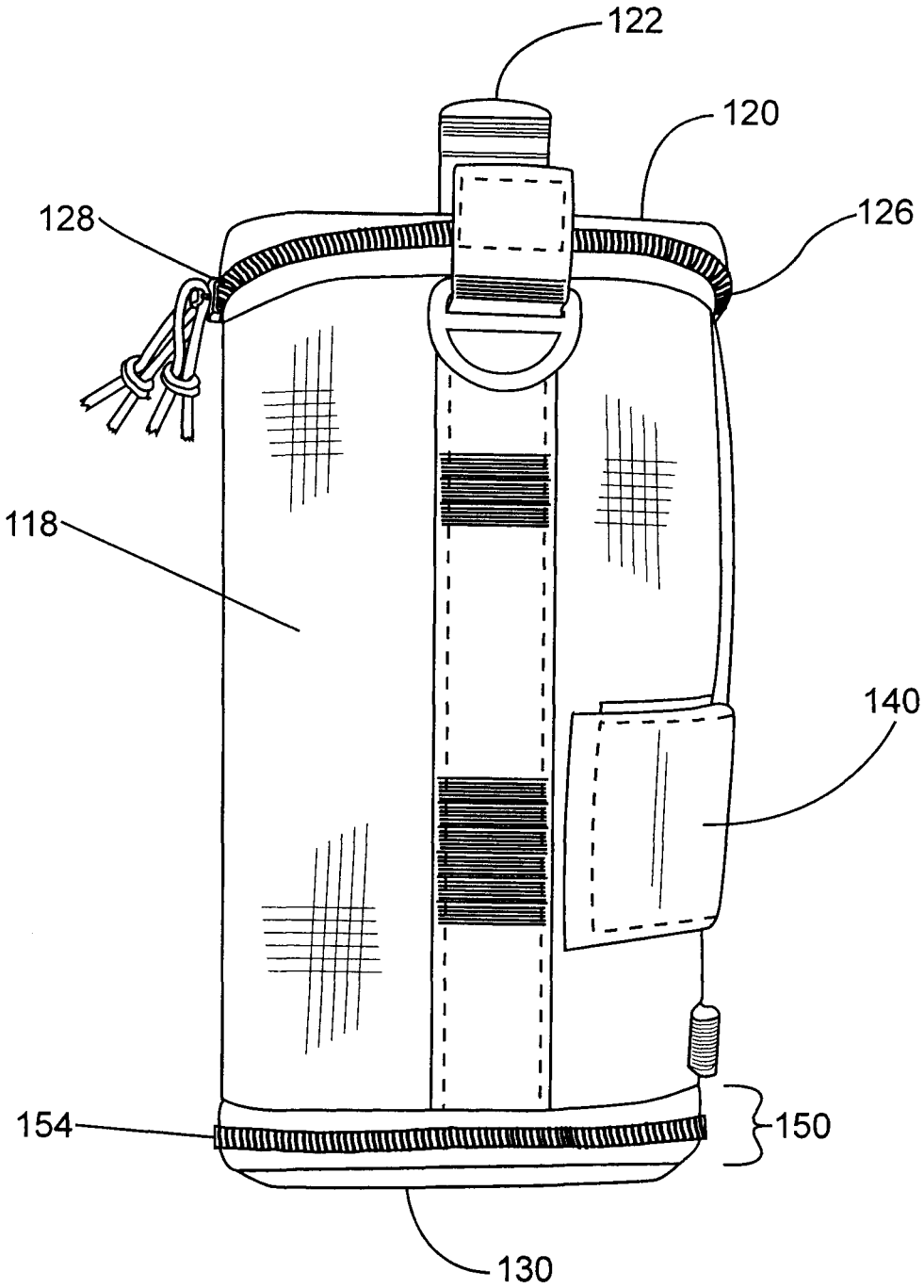
FIG. 11 is a right side perspective view of the carrier shown in FIG. 6.
Figure 12:
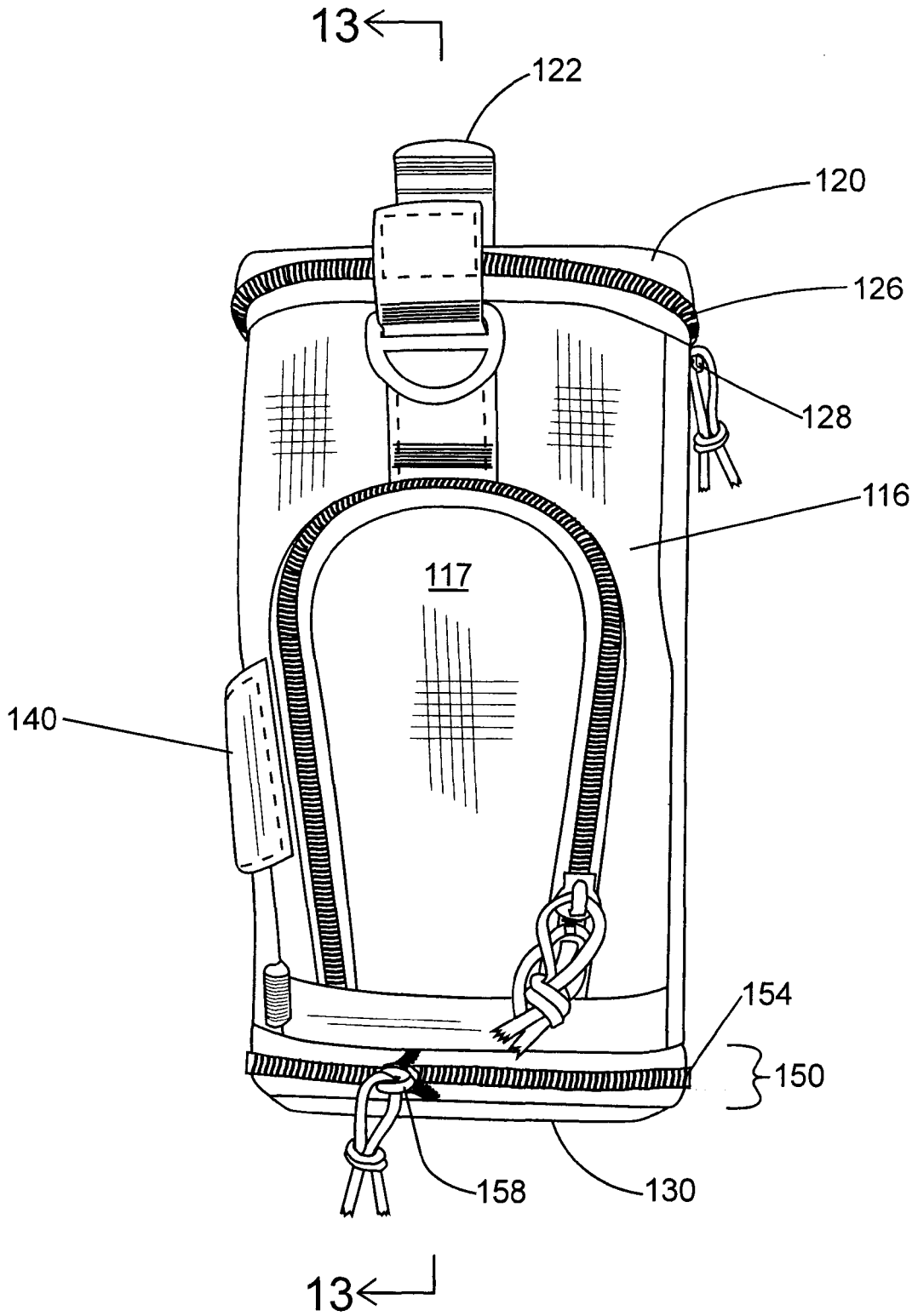
FIG. 12 is a left side perspective view of the carrier shown in FIG. 6.

FIGS. 3 and 4 show the carrier 1 in the extended configuration. As shown in the schematic cross-section of FIG. 2, this would be appropriate for carrying a lens 2 with the hood 2A attached to the lens 2 and extending from it in the deployed configuration. Alternatively, the extended configuration would permit the carrier to securely contain a longer lens.

As noted before, the expansion gusset region 50 joins the bottom 30 to the wall 10. A gusset 52, preferably comprised of fabric, is sewn to both the wall 10 and the bottom 30. The gusset 52 will keep the bottom 30 joined to the wall 20 when the expansion gusset region 50 is in the expanded configuration and will keep dust, water, and other undesired elements out of the compartment 15. The gusset 52 may be padded with foam sheeting or the like although this is not shown in the drawings.

The gusset preferably should have a vertical dimension sufficiently great to cause a vertical expansion of the compartment 15 that will permit the compartment 15 to completely accommodate the lens 2 with a lens hood 2A in the operative position as shown in FIG. 4. The lens 2 will be securely contained in the compartment 15 without extending from it any more than it did in the configuration of FIG. 2, which is preferably not at all.

Alternatively, a single carrier 1 may accommodate securely lenses of different length as long as the circumference of the lens does not increase beyond the inner circumference of the compartment 15. This conveniently provides a single carrier that can fit more than one lens.

A zipper 54 having zipper halves 54A and 54B joined and separated by the movement of zipper slider 56 is arranged so as to contract the gusset 52 and move the bottom 30 against the wall 10 as shown in FIGS. 1 and 2. The zipper halves 54A and 54B are attached to zipper tapes 56A and 56B, respectively. The upper and lower zipper tapes 56A and 56B are sewn or otherwise attached to the wall 10 and the bottom 30, respectively, for a full circumference of the wall 10 or bottom 30, as the case may be (the circumferences will be about the same). However, the zipper 54 and the zipper tapes 56A and 56B are longer than the full circumferences of the wall 10 or bottom 30, as the case may be. The portions of the zipper tapes 56A and 56B that exceed the lengths of the circumferences may have a length of about a quarter of a circumference (as shown in the drawings). The portions of the zipper tapes 56A and 56B that exceed the lengths of the circumferences are not sewn or attached to the wall 10 or the bottom 30, respectively. Instead, they are sewn to the gusset 52 so that they converge together (see FIG. 3). Accordingly, when the zipper 54 is unzipped (the zipper slider 58 is maneuvered so as to separate the zipper halves 54A and 54B), the wall 10 is separated from the bottom 30 and the gusset 52 is extended from its contracted or stored position shown in FIG. 2 to its full vertically extended position shown in FIG. 4. When the zipper 54 is zipped up (the zipper slider 58 is maneuvered so as to join the zipper halves 54A and 54B), the wall 10 is brought to be adjacent the bottom 30 and the gusset 52 is placed in its contracted or stored position shown in FIG. 2 from its full vertically extended position shown in FIG. 4.

It will be understood by those of skill in the art that other means for extending and contracting the gusset 52 may be employed. For example, hook-and-loop tape might be employed to secure the bottom 30 to the wall 10.

Figure 13:
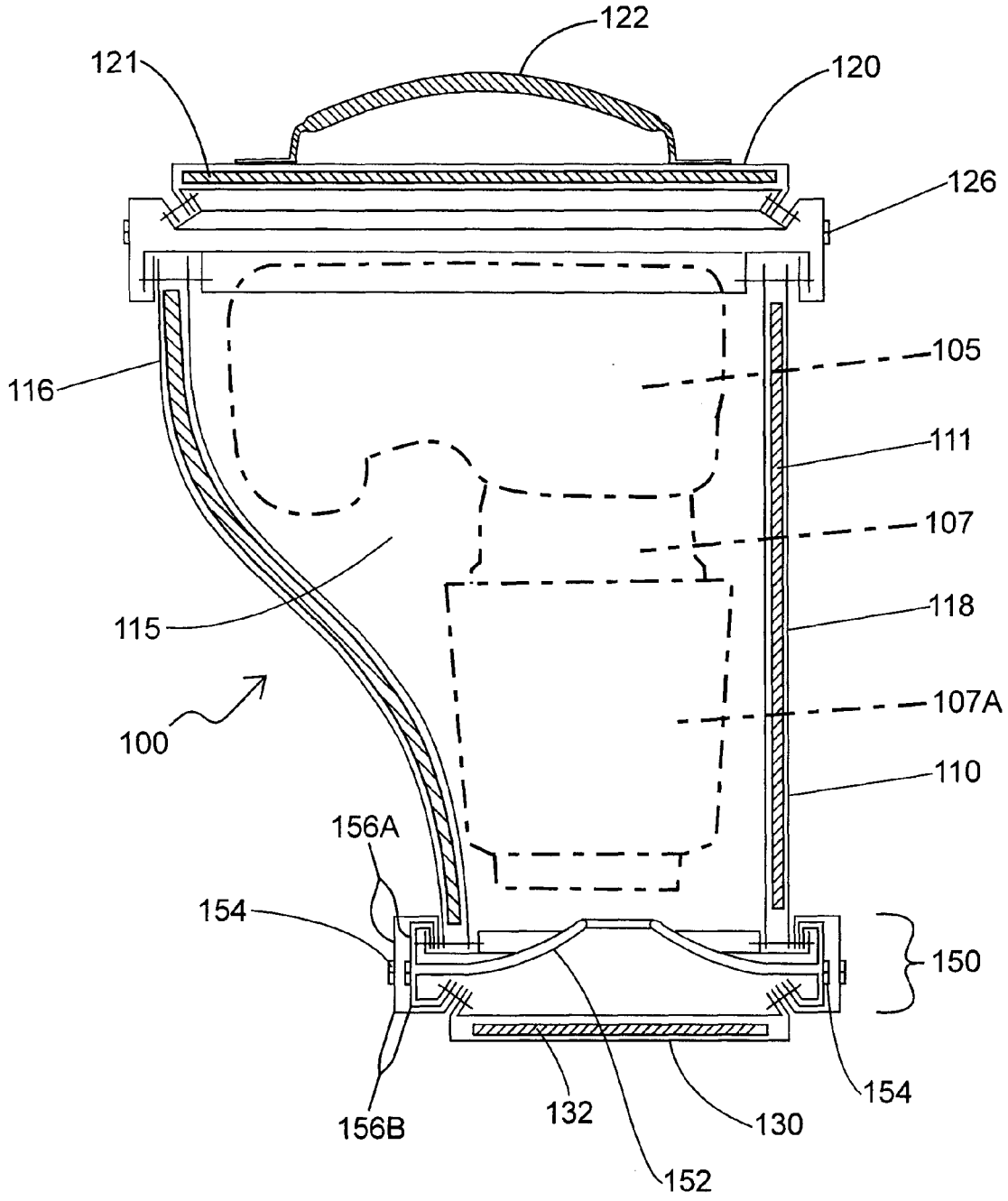
FIG. 13 is a schematic of a sectional view of the carrier shown in FIG. 12, taken along the line 13-13, with a camera and lens indicated in phantom.
Figure 14:
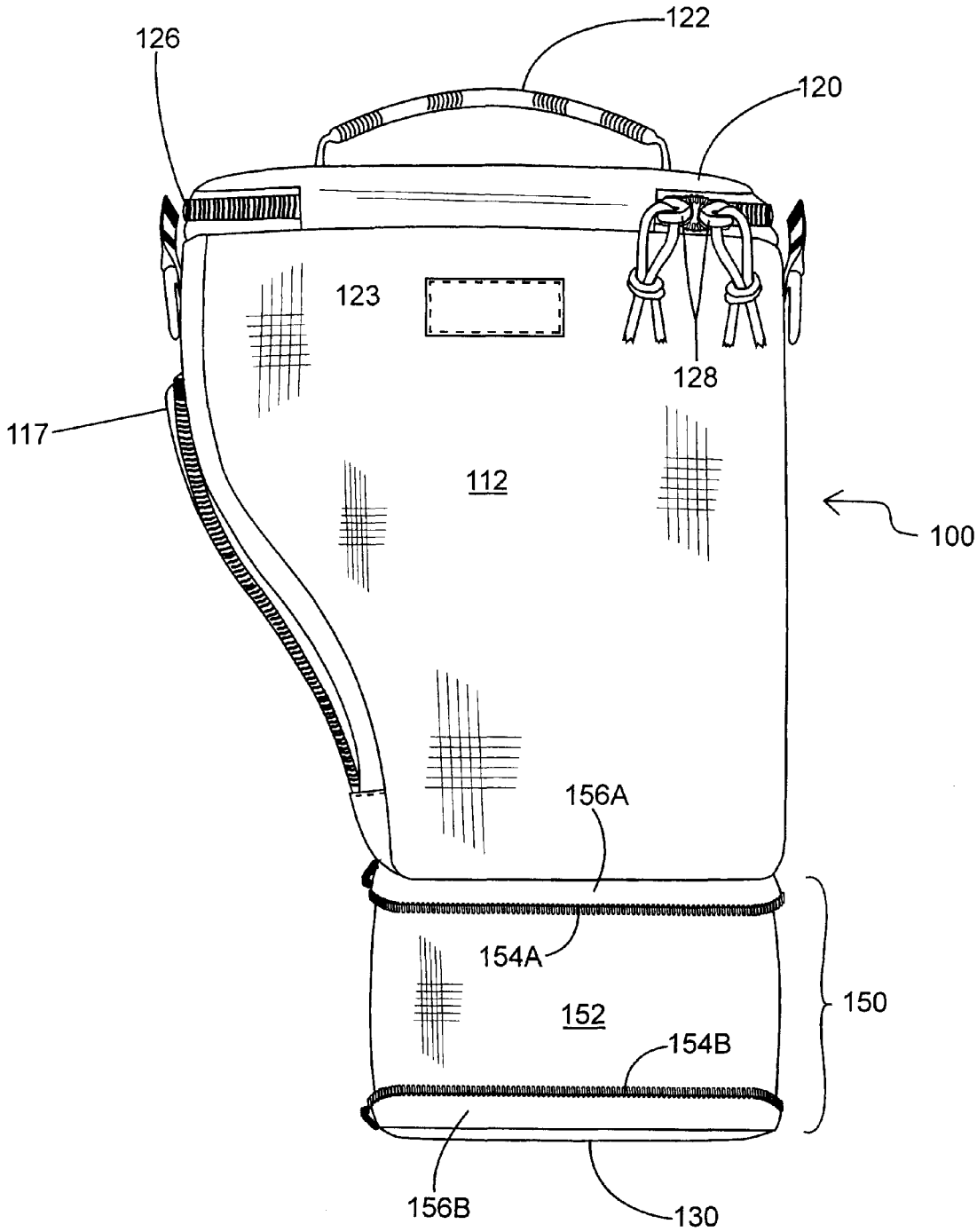
FIG. 14 is a front side perspective view of the carrier shown in FIG. 6, but in a second or extended configuration.
Figure 15:
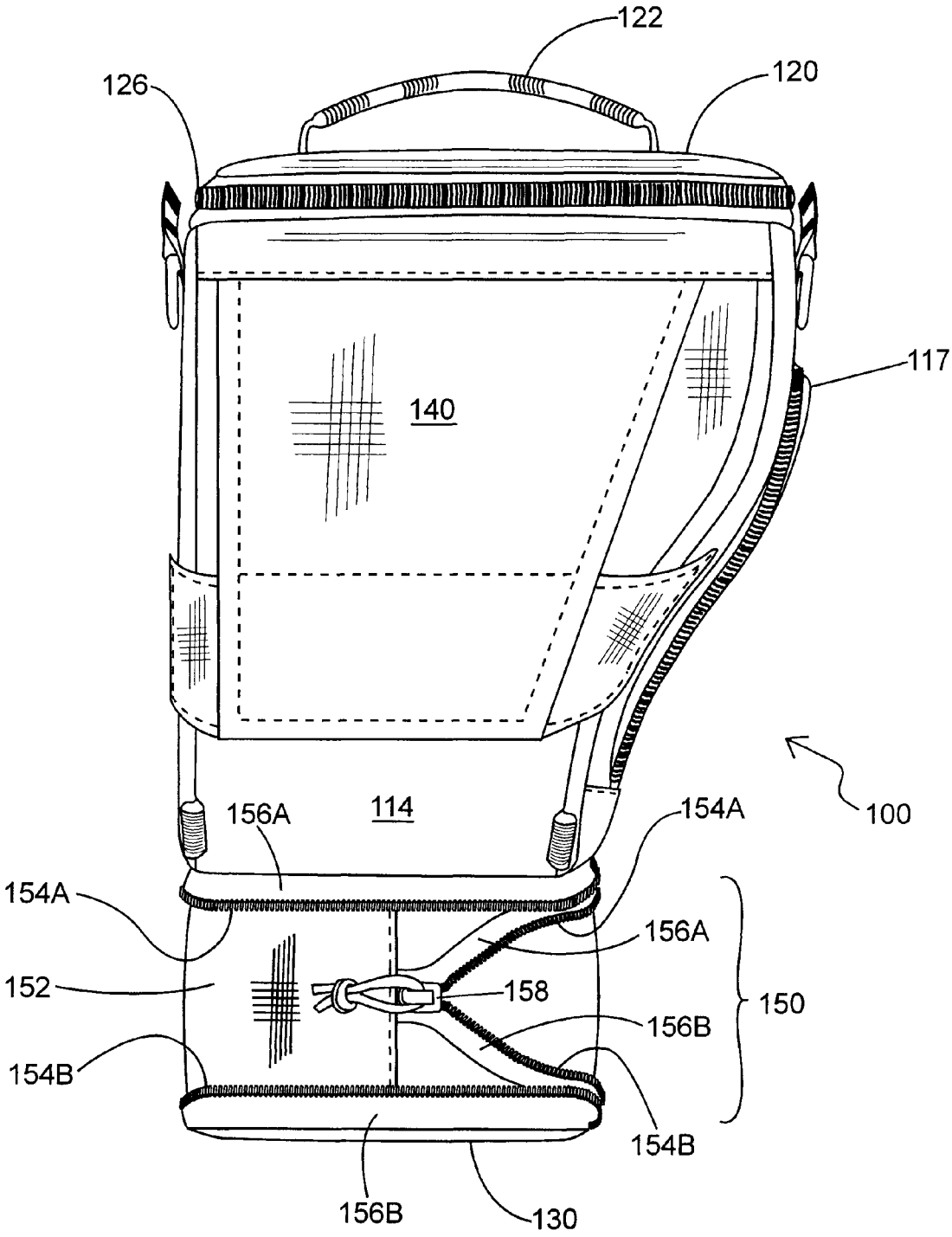
FIG. 15 is a back side perspective view of the carrier shown in FIG. 14.
Figure 16:
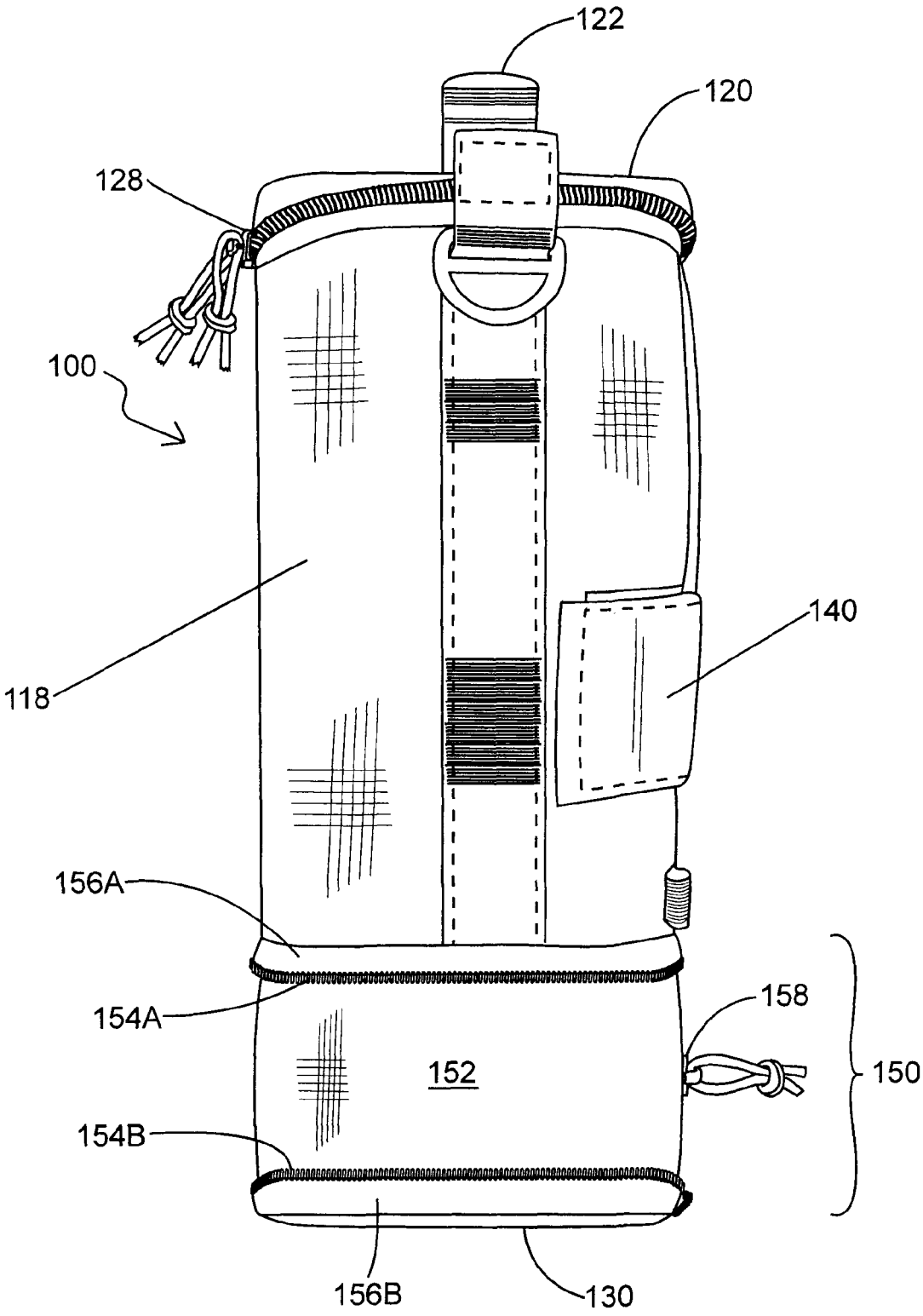
FIG. 16 is a right side perspective view of the carrier shown in FIG. 14.
Figure 17:
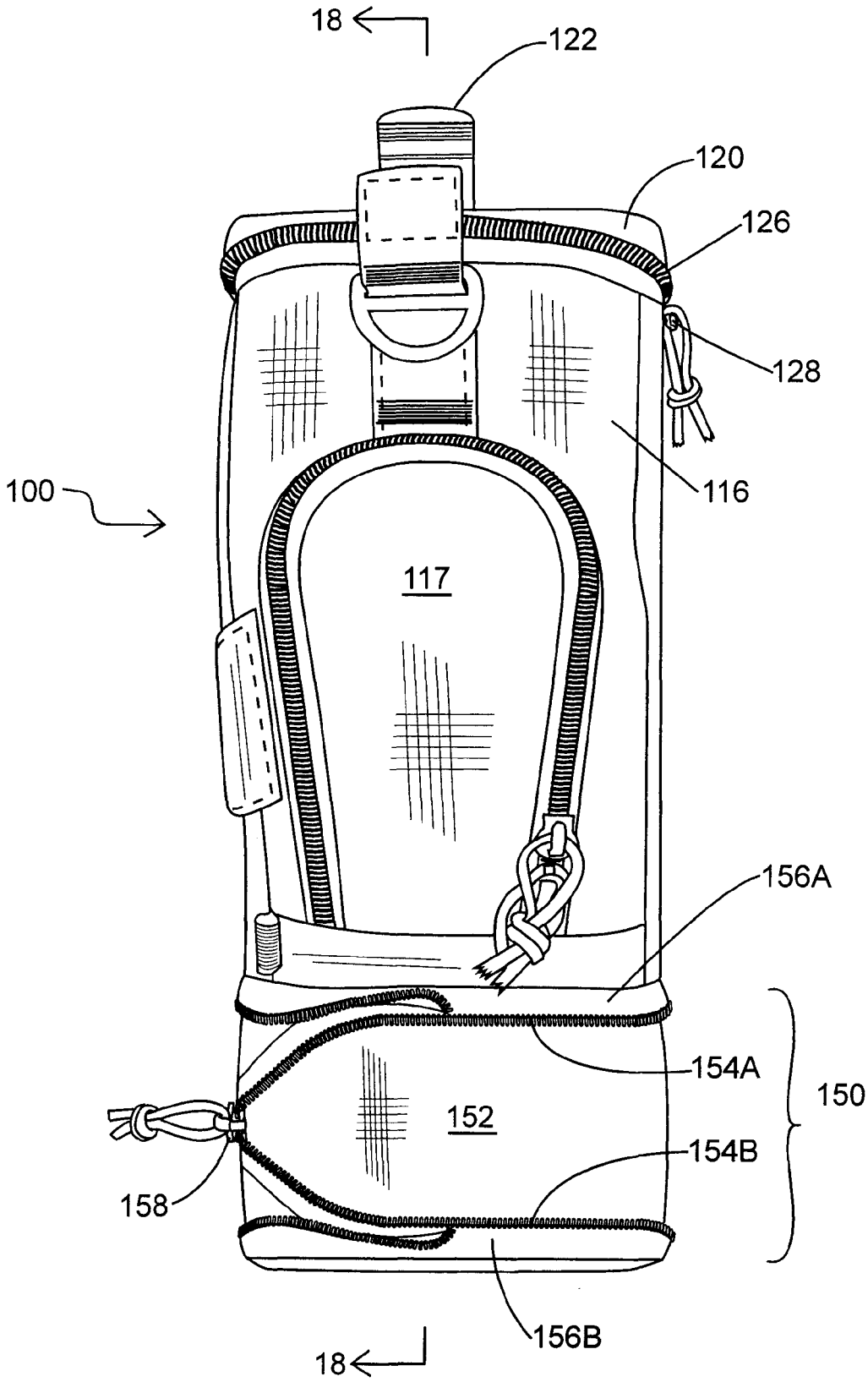
FIG. 17 is a left side perspective view of the carrier shown in FIG. 14.
Figure 18:
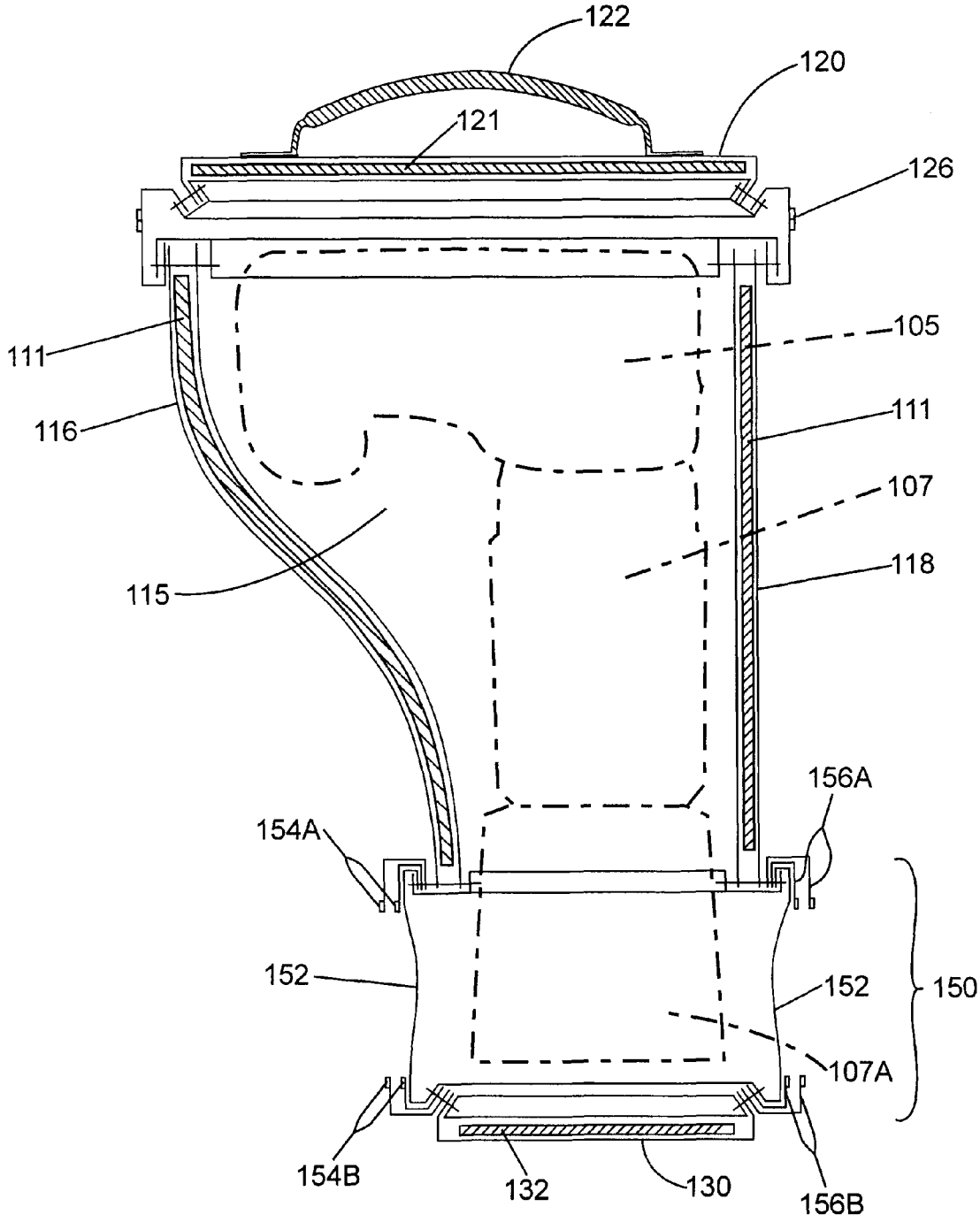
FIG. 18 is a schematic of a sectional view of the carrier shown in FIG. 17, taken along the line 18-18, with a camera and lens indicated in phantom.

FIGS. 6-18 depict a second preferred embodiment of a carrier 100 according to the disclosure. The carrier 100 is essentially a container for a substantially rectangular parallelopipedal object with a cylindrical object of varying length attached on one side, such as, as shown in FIGS. 13 and 18, a single lens reflex camera 105 and a telephoto lens 107 that may have its lens hood 107A either reversed (FIG. 13) or extended (FIG. 18).

The carrier 100 has a wall 100 composed of a front wall 112 joined by a left wall 116 and a right wall 118 to a back wall 114. A top 120 is attached by hinge 123 to the front wall 112 and joined by a zipper 126 with zipper sliders 128 to the left wall 116, the right wall 118, the back wall 114, and portions of the front wall 112. A bottom 130 is connected by an expansion gusset region 150 to the wall 110.

The top 120, the wall 110, the expansion gusset region 150, and the bottom 130 define a compartment 115 that is accessed through the top opening 124 that is covered by the top 120 when the zipper 126 is closed.

The carrier 100 shown in the drawings is a soft-sided case designed to hold and protect photographic gear and it is therefore padded. The top 120 has a foam padding 121 in the form of a foam sheet sandwiched by fabric layers; the wall 110 has foam padding 111, and the bottom has foam padding 131. The general manner of construction of the carrier 100 out of fabric, foam sheeting, zippers, zipper sliders, strapping, D-rings, and the like sewn together will be known to those of skill in the art although the design will not. The wall 110, top 120, and the bottom 130 could be made of harder materials to provide a hard-sided case, if needed, as mentioned above in connection with the carrier 1 of the embodiment of FIGS. 1-5.

A belt connection sleeve 140 is provided on the back wall 114. The belt connection sleeve 140 may be the same as the one disclosed in connection with the carrier 1 and the same comments apply. The top 120 is provided with a handle 122 for holding the carrier 100 with the hand when the carrier 100 is not supported on a belt or by a shoulder strap (the belt and the shoulder strap are not shown in the drawings). The left wall 116 is shown with a sleeve or flap zippered thereon to form a left side zippered compartment 117. Those of skill in the art will be aware that many variations in the position, form, and structure of the belt connection sleeve 140, the handle 122, and the left side zippered compartment 117 are possible.

The expansion gusset region 150 has generally the same construction as the expansion gusset region 50 in the carrier 50 and provides a gusset 152 that can be contracted or expanded so as to displace the bottom 130 away from the wall 110 so as to accommodate variations in the length of the article or device enclosed in the compartment 115 of the carrier 100. In other words, the article or device may be enclosed in the compartment 115 with the top 120 zippered shut over the opening 124 even though the length of the article or device may change. In the drawings, one will see that the article is an SLR camera body 105 attached to a lens 107 (a telephoto lens in the drawings). The lens 107 changes its length when the lens hood 107A changes orientation from being reversed on the lens (FIG. 13) to being extended for ready use (FIG. 18). Alternatively, the expansion gusset region 150 may allow the compartment 115 of the carrier 100 to accommodate a camera 105 having a longer lens attached. The carrier 100 can thus be useful for securely containing cameras with lenses of different lengths as long as the circumference of the lens does not increase beyond the inner circumference of the compartment 115.

While illustrative embodiments of the carriers disclosed herein have been shown and described in the above description, numerous variations and alternative embodiments will occur to those skilled in the art and it should be understood that, within the scope of the appended claims, the invention may be practiced otherwise than as specifically described. Such variations and alternative embodiments are contemplated, and can be made, without departing from the scope of the invention as defined in the appended claims.

What is claimed is:

1. A carrier for carrying a substantially cylindrical telephoto lens having a shorter length when an accompanying lens hood is mounted on the lens in a reversed position and a longer length when the accompanying lens hood is mounted on the lens in an extended position, comprising:

a wall having an upper end defining an opening sized to receive an end of the lens and a lower end, a bottom, an expanding gusset region comprising a gusset disposed between the lower end of the wall and the bottom, and a device at least partially secured to each of the lower end of the wall and to the bottom, the device being capable of reversibly securing the bottom adjacent the lower end of the wall and permitting the bottom to displace away from the lower end of the wall, the wall, the expanding gusset region, and the bottom defining a generally cylindrical variable-length compartment having a diameter substantially the same as or greater than that of the lens and the lens hood, wherein the compartment is adapted to fit the lens and the lens hood, and whereby the lens with the lens hood attached to the lens in the reversed position is accommodated within the variable-length compartment when the variable length compartment is not expanded, and the lens with the lens hood attached to the lens in the extended position is accommodated within the variable-length compartment when the variable length compartment is expanded, and further comprising a belt connection sleeve having a first end attached to the wall and a second end capable of attachment to the wall, the first end and the second end of the sleeve being spaced apart at their respective places of attachment to the wall so that the second end of the sleeve can be folded over a belt and attached to the wall whereby the carrier may be borne by the belt, and the second end of the sleeve may be detached from the wall whereby the carrier may be removed from the belt.

2. The carrier according to claim 1 wherein the device is a zipper partially secured to or adjacent to each of the lower end of the wall and the bottom.

3. The carrier according to claim 2 wherein the gusset has a contracted configuration in which the wall is adjacent the bottom and an expanded configuration in which the wall is spaced from the bottom.

4. The carrier according to claim 2 wherein the zipper comprises first and second zipper halves, the first zipper half being attached to and extending at least part of the circumference of the lower end of the wall, the second zipper half being attached to and extending at least part of the circumference of the bottom, the first zipper half being longer than the at least part of the circumference of the lower end of the wall, the second zipper half being longer than the at least part of the circumference of the bottom, and the portions of the first and second zipper halves that exceed the at least part of the circumferences of the lower end of the wall and the bottom, respectively, being attached to the gusset so that they converge together.

5. The carrier according to claim 1 further comprising a cord and a locking device for closing the opening.

6. The carrier according to claim 1 further comprising a top, the top being adapted for covering the opening.

7. The carrier according to claim 1 wherein the second end of the sleeve further comprises means for detachable attachment to the wall.

8. The carrier according to claim 1 wherein the variable-length compartment is sized and shaped to accommodate a lens unattached to a camera.

9. A carrier for carrying a substantially rectangular parallelopipedal camera body attached to a substantially cylindrical telephoto lens, the lens having a shorter length when an accompanying lens hood is mounted on the lens in a reversed position and a longer length when the accompanying lens hood is mounted on the lens in an extended position, the carrier comprising:

a wall having an upper end defining an opening sized to receive the camera body and the lens and a lower end, a bottom, an expanding gusset region comprising a gusset disposed between the lower end of the wall and the bottom, and a device at least partially secured to each of the lower end of the wall and to the bottom, the device being capable of reversibly securing the bottom adjacent the lower end of the wall and permitting the bottom to displace away from the lower end of the wall, the wall, the expanding gusset region, and the bottom define a compartment having an upper portion with a rectangular cross-section adapted to fit the camera body and a variable-length lower portion adapted to fit the lens and the lens hood, wherein the lens with the lens hood attached to the lens in the reversed position is accommodated within the variable-length compartment when the variable length compartment is not expanded, and the lens with the lens hood attached to the lens in the extended position is accommodated within the variable-length compartment when the variable length compartment is expanded, and further comprising a belt connection sleeve having a first end attached to the wall and a second end capable of attachment to the wall, the first end and the second end of the sleeve being spaced apart at their respective places of attachment to the wall so that the second end of the sleeve can be folded over a belt and attached to the wall whereby the carrier may be borne by the belt, and the second end of the sleeve may be detached from the wall whereby the carrier may be removed from the belt.

10. The carrier according to claim 9 wherein the device is a zipper comprising first and second zipper halves, the first zipper half being attached to and extending at least part of the circumference of the lower end of the wall, the second zipper half being attached to and extending at least part of the circumference of the bottom, the first zipper half being longer than the at least part of the circumference of the lower end of the wall, the second zipper half being longer than the at least part of the circumference of the bottom, and the portions of the first and second zipper halves that exceed the at least part of the circumferences of the lower end of the wall and the bottom, respectively, being attached to the gusset so that they converge together.

11. The carrier according to claim 9 further comprising a top reversibly secured to the wall above the variable-length compartment.

12. The carrier according to claim 9 wherein the second end of the sleeve further comprises means for detachable attachment to the wall.

* * * * *